US005190716A

United States Patent [19]

Brückner et al.

[11] Patent Number: 5,190,716

[45] Date of Patent: Mar. 2, 1993

[54] PROCESS FOR MANUFACTURING AND PREHEATING A SHAPED CERAMIC PART

[75] Inventors: Raimund Brückner, Engenhahn; Hans Rothfuss, Taunusstein; Albert Ott, Waldems-Wüstems; Ernst Lührsen, Bad Schwalbach, all of Fed. Rep. of Germany

[73] Assignee: Didier-Werke AG, Wiesbaden, Fed. Rep. of Germany

[21] Appl. No.: 794,056

[22] Filed: Nov. 19, 1991

[30] Foreign Application Priority Data

Nov. 29, 1990 [DE] Fed. Rep. of Germany ..... 4038061

[51] Int. Cl.[5] ..... B22D 41/60

[52] U.S. Cl. ..... 266/44; 266/236; 222/593

[58] Field of Search ..... 222/592, 593; 266/236, 266/280, 286, 44; 264/30

[56] References Cited

U.S. PATENT DOCUMENTS 4,455,014 6/1984 Genies ..... 266/286

4,869,468 9/1989 Johnson ..... 266/286

*Primary Examiner*—Scott Kastler

*Attorney, Agent, or Firm*—Wenderoth, Lind & Ponack

[57] ABSTRACT

A ceramic part to be used in a high temperature environment and that is preheated prior to use is manufactured by a process including shaping the part and subjecting the part to a heat treatment operation. The heat treatment operation is performed at least partially on location at a position of use of the part in the high temperature environment by a heating device that also is operated to perform the preheating of the part.

16 Claims, 1 Drawing Sheet

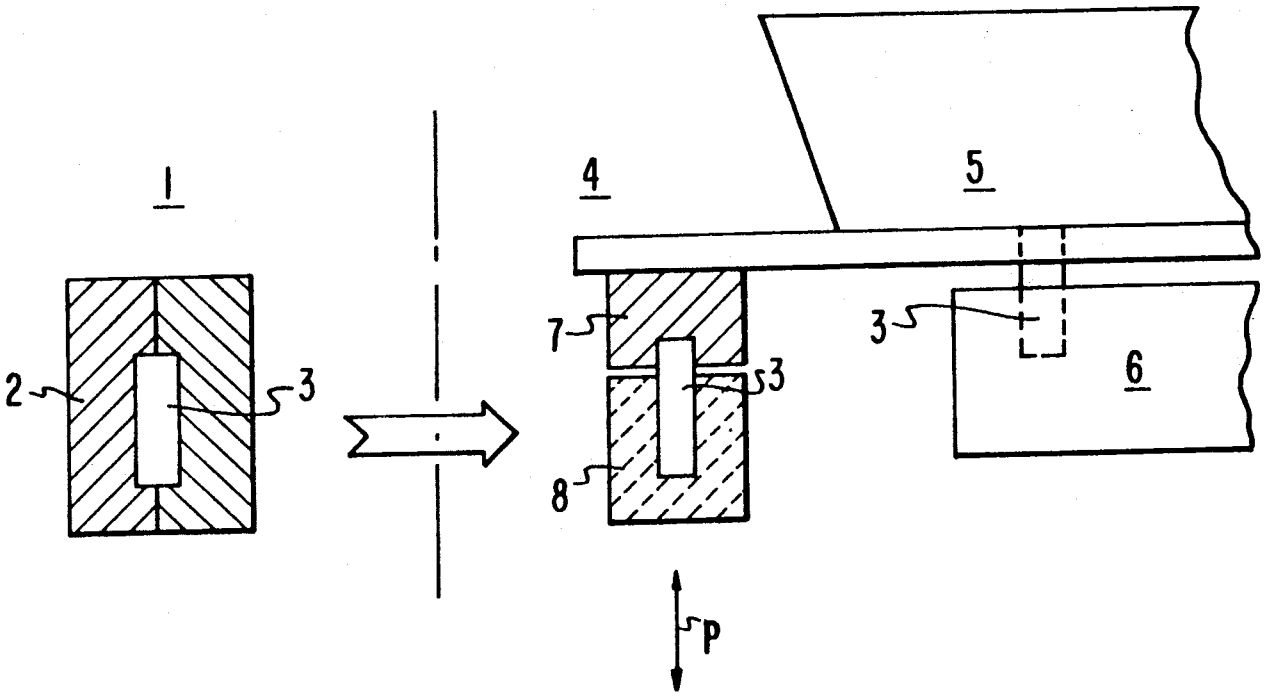
1
2
3
4
5
6
7
8
P

PROCESS FOR MANUFACTURING AND PREHEATING A SHAPED CERAMIC PART

BACKGROUND OF THE INVENTION

The present invention relates to a process for manufacturing a ceramic part, for example a brick, plate, rod or pipe, to be used in a high temperature environment or application and that is preheated prior to such use, such process including forming the refractory part by shaping and subjecting such part to a heat treatment operation, to thus impart to the part properties suitable for the high temperature use. The present invention particularly is directed to a process for the manufacture of such ceramic parts that are employable in metallurgical continuous casting insulations.

According to the state of the art, such ceramic parts are shaped of a ceramic mixture of suitable materials and then are subjected to a heat treatment operation, particularly a firing operation. After such heat treatment operation the parts then are cooled down and stored, and subsequently are assembled on location at particular positions of use according to their respective intended purposes. Prior to utilization at such positions of use, and particularly in high temperature environments, it is necessary that such parts be preheated. Such preheating is necessary for a number of reasons, and particularly is desirable in metallurgical continuous casting installations.

U.S. Pat. No. 3,435,992 discloses a shaped ceramic part employed as a funnel for a nozzle of a metallurgical vessel in a continuous casting installation. The nozzle is heated on location electrically. If the nozzle is electrically conductive, heating is achieved inductively by an induction coil. Capacitive or dielectric heating and resistance heating also are possible.

U.S. Pat. No. 4,359,625 discloses a shaped part in the form of an immersion nozzle for a continuous casting installation. The immersion nozzle is heated by resistance heating on location at the position of utilization, and the material of the immersion nozzle is electrically conductive. Heat installation is proposed to reduce heat dissipation of the heated immersion nozzle.

German patent application P 40 35 496.2 discloses a device wherein an immersion nozzle is swiveled by a heating device into position in a continuous casting installation.

In all such known prior art systems, the shaped ceramic part first is formed, for example by molding or another shaping operation, and subsequently is heat treated, for example fired. This completely finished shaped ceramic part then is moved, with possible intermediate transportation and storage, to a position of utilization whereat it again is necessary to preheat the part before it can be used in the particular high temperature environment. This procedure of manufacture involves a substantial expense, and particularly a substantial consumption of energy. Thus, substantial energy is required both for the heat treatment operation during manufacture of the ceramic part and then later for the preheating of the part at the position of utilization.

SUMMARY OF THE INVENTION

With the above discussion in mind, it is an object of the present invention to provide an improved process for the manufacture of a shaped ceramic part to be used in a high temperature environment, but wherein it is possible to overcome the above and other prior art disadvantages.

It is a more specific object of the present invention to provide such an improved process whereby it is possible to reduce the time and expense required for manufacture of shaped ceramic parts to be used in high temperature environments and that must be preheated prior to use.

It is a further more specific object of the present invention to provide such an improved process whereby the overall consumption of energy necessary for manufacture and use of such a shaped ceramic part is reduced.

These objects are achieved in accordance with the present invention by the provision of an improved process comprising performing the heat treatment operation necessary to manufacture a ceramic part capable of use in the high temperature environment at least partially on location at a position of use of such part in the high temperature environment by means of a heating device that also is employed to perform the preheating of the ceramic part. In other words, in accordance with the present invention, the same or substantially the same energy employed for preheating the part prior to use in the high temperature environment also is employed to perform the heat treatment operation necessary for formation of the shaped ceramic part. As employed herein the term shaped is intended to refer to molding of a ceramic part or formation of such ceramic part by any other known and conventional shaping operation.

As a result of this process of the present invention, it is not necessary to cool the shaped part between the heat treatment thereof, and which is included in the manufacture of the part, and the preheating of the part that is necessary, or at least advantageous, prior to use of the part at the position of utilization thereof. Therefore, not only is the same energy, or at least significantly the same energy, employed for both heating operations, but also the avoidance of cooling of the part between such two heating operations substantially reduces the total amount of energy required. Also, the process of the invention permits the use of ceramic materials that are more sensitive to temperature change resistance. The entire heat treatment operation of the shaped part may be accomplished by the heating device at the same time as the part is preheated. However, this is not absolutely necessary, and the entire heat treatment operation does not have to be achieved by the heating device. Thus, insofar as it is necessary for the required stability of the shaped or molded part during transportation thereof to the position of use, a partial heat treatment operation can be conducted immediately following shaping or molding of the part. Thereafter, only the final portion of the heat treatment operation need be carried out by the heating device during preheating of the part thereby at the position of use. The total time required for manufacture of the part is reduced in accordance with the present invention. That is, as indicated above, during the formation operation in which a ceramic mixture is shaped or molded, the cooling period is dispensed with, and at least part of the heat treatment operation is dispensed with. Furthermore, the process of the present invention results in a reduction in the amount of equipment necessary for manufacture of the shaped ceramic part, since a single heating device suffices to carry out the heat treatment operation and also the preheating operation. Preferably, both the heat treatment operation and the preheating are conducted simultaneously by the heating device. However, it also is possible to operate the heating device at one temperature level necessary for the heat treatment operation and thereafter to operate the heating device at a different temperature, for example an increased temperature, necessary for the preheating operation.

The ceramic material of the part may be electrically conductive, and the heat treatment operation and the preheating may be conducted inductively by means of an inductor as the heating device. Also, the part may have dielectric properties, and heat treatment operation and the preheating may be conducted capacitively, for example by means of capacitor plates as the heating device. The part may have electrical resistance, and the heat treatment operation and the preheating may be conducted by resistance heating. Additionally, the heat treatment operation and the preheating may be conducted by heat radiation and/or heat conduction. In such a case, the heating device may include a heating element that may surround the part and/or be inserted into the part. Furthermore, the heat treatment operation and the preheating may be achieved by means of a burner as/or of the heating device.

In accordance with a further feature of the present invention, the heating device may be raised to perform the heat treatment operation and the preheating, and thereafter the heating device may be lowered to release the part. Also, after the heat treatment operation and the preheating, the heating device may be maintained on the part as heat insulation.

In accordance with a particular embodiment of the present invention, the heating device is integrated with or can be integrated with a device for inserting and/or connecting the shaped part in an operating position on a metallurgical vessel or a shut-off device thereof. After completion of the heat treatment operation and the preheating, the insertion or connection device may be operated, for example by swivelling thereof, to insert the part into operating position thereof on the metallurgical vessel. This arrangement particularly is useful when the part is an immersion nozzle for a continuous casting operation. The part also advantageously may be a shadow pipe (shroud).

BRIEF DESCRIPTION OF THE DRAWING

Other objects, features and advantages of the present invention will be apparent from the following detailed description, taken with the accompanying drawing, wherein:

The single FIGURE is a schematic view illustrating various features of the process of the present invention.

DETAILED DESCRIPTION OF THE INVENTION

In FIG. 1 is shown a shaping location 1, for example a molding shop, separated from a location of use, for example a continuous casting installation 4. At location 1, suitable ceramic materials are shaped to form a ceramic shaped part, for example an immersion nozzle 3. In the schematic illustration of the drawing, shaping is achieved at location 1 by means of a mold 2. It is to be understood however that shaping of the part 3 could be achieved by any known and conventional technique.

At location 1 it is necessary that nozzle 3 be stabilized to an extent sufficient that it is capable of undergoing transportation to location 4. Such stabilization may be possible by the shaping operation, or it may be necessary to subject the shaped part 3 to an initial partial heat treatment operation at location 1. However, the heat treatment operation sufficient to impart to the part properties sufficient for a high temperature use is not completed at location 1. Rather, the part 3 is transported from location 1 to location 4, i.e. at a position of use of the part 3 in a high temperature environment. It is at this location that the heat treatment operation is finished, or alternatively conducted entirely.

The location 4 as illustrated in the drawing is, as indicated above, intended to represent a continuous casting installation including a first metallurgical vessel 5, for example a tundish, and a second metallurgical vessel 6, for example a continuous casting mold. In the particular arrangement illustrated, an insertion and/or connecting device 7 is provided and operates to move a preheated part 3 to an operating position (shown in dashed lines in the drawing). Integrated into the insertion device 7 is a heating device 8 that is employed to conduct the heat treatment operation and a preheating operation, in a manner to be discussed in more detail below. The above elements are illustrated schematically only in the drawing, in as much as the present invention is contemplated as being useful in all known such systems and with known such devices.

As illustrated, the shaped part 3 is located in or with respect to heating device 8. The heating device 8 then is raised with respect to insertion device 7. The heating device 8 is operated to conduct both the heat treatment operation, at least sufficient to complete such heat treatment operation, and also to preheat the part 3 as is necessary for use of the part 3 in the installation 5, 6. This relative raising and lowering of heating device 8 is illustrated by the double-headed arrow P.

Thus, heating device 8 achieves at least the completion of the necessary heat treatment operation of the part 3, such that the material of part 3 has properties suitable for use in the intended high temperature environment. The heating device 8 also preheats the part 3 to a desired temperature after which the part is inserted into an operating position relative to members 5, 6. The part 3 does not have to be cooled between the completion of the heat treatment operation and the preheating operation.

The heating device 8 in accordance with the process of the present invention may be operated according to a number of varying principles of operation. Thus, heating device 8 can operate as an inductor with an electromagnetic induction coil, such that eddy currents are induced in part 3 that is formed of an electrically conductive material. Such eddy currents then raise the temperature of the part 3 to the desired temperature. However, the heating device 8 also can function capacitively, for example by means of capacitor plates as the heating device and by providing that the part 3 is of a material having dielectric properties. Thus, the part 3 is subjected to an AC field and is heated. Even further, the part 3 can be electrically resistive, such that the part then is heated by resistance heating. Even further, it is possible to heat the part 3 by heat radiation or heat conduction. For example, the heating device may include a heating element surrounding the part 3 and/or inserted into the part 3. Even further, the heating device may include a burner that achieves heating of the part 3.

In accordance with a further feature of the present invention, the heating device 8 may be employed to form heat insulation for the part 3 at the completion of the heat treatment operation and the preheating operation.

In the particular embodiment of the present invention illustrated in the drawing, insertion and connection device 7 can operate in the above described manner. Also, the yet unfinished part 3 may be inserted into device 7. Subsequently, heating device may be raised and operated to subject the part 3 to the heat treatment operation. Immediately following completion of the heat treatment operation, the heating device 8 then may be operated at the same or a different temperature, for example an increased temperature, to achieve the desired preheating of the part 3. When the part 3 is to be moved to position with respect to elements 5, 6, heating device 8 is lowered from device 7 and part 3, and device 7 then is operated to move, for example by swivelling, the heated part 3 into position relative to elements 5, 6.

Although the present invention has been described with respect to a ceramic shaped part that particularly is in the form of an immersion nozzle, it is to be understood that the present invention equally is applicable to other ceramic shaped parts, for example a shadow pipe, etc. Furthermore, although the present invention has been described and illustrated with respect to preferred features, it is to be understood that various modifications may be made to the specifically described and illustrated features without departing from the scope of the present invention.

We claim:

1. A process for manufacturing a ceramic part comprising an immersion nozzle or shroud which is to be subjected to a heat treatment operation, is to be mounted on a metallurgical vessel for use in a high temperature environment while contacted by molten metal, and is to be preheated prior to such use, said process comprising:

shaping said part at a shaping location;

providing at a position of use a heating device integrated into an insertion device for inserting said part to an operating position on said metallurgical vessel;

transferring said part from said shaping location to said heating device; and operating said heating device and thereby at least partially performing said heat treatment operation and thereby also forming said preheating.

2. The process claimed in claim 1, wherein said heat treatment operation and said preheating are conducted simultaneously by said heating device.

3. The process claimed in claim 1, wherein said heat treatment operation is performed entirely by said heating device.

4. The process claimed in claim 1, comprising partially performing said heat treatment operation at said shaping location of, and then completing said heat treatment operation by means of said heating device at said position of use.

5. The process claimed in claim 1, wherein said part is electrically conductive, and said heat treatment operation and said preheating are conducted inductively by means of an inductor as said heating device.

6. The process claimed in claim 1, wherein said part has dielectric properties, and said heat treatment operation and said preheating are conducted capacitively by means of capacitor plates as said heating device.

7. The process claimed in claim 1, wherein said part is electrically resistive, and said heat treatment operation and said preheating are conducted by resistance heating.

8. The process claimed in claim 1, comprising conducting said heat treatment operation and said preheating by heat radiation.

9. The process claimed in claim 1, comprising conducting said heat treatment operation and said preheating by heat conduction.

10. The process claimed in claim 1, comprising surrounding said part by said heating device and conducting said heat treatment operation and said preheating thereby.

11. The process claimed in claim 1, comprising inserting said heating device into said part and conducting said heat treatment operation and said preheating thereby.

12. The process claimed in claim 1, comprising conducting said heat treatment operation and said preheating by means of a burner as said heating device.

13. The process claimed in claim 1, wherein said heating device is raised to perform said heat treatment operation and said preheating, and following said heat treatment operation and said preheating said heating device is lowered to thereby release said part.

14. The process claimed in claim 1, wherein after conducting said heat treatment operation and said preheating, said heating device is maintained on said part as heat insulation.

15. The process claimed in claim 1, comprising, after completion of said heat treatment operation and said preheating, operation said insertion device to insert said part to said operating position on said metallurgical vessel.

16. The process claimed in claim 1, wherein said shaping comprises molding said part.

* * * * *